United States Patent [19]

Kim et al.

[11] Patent Number: 5,066,455

[45] Date of Patent: Nov. 19, 1991

[54] ALLOY STEEL WIRES SUITABLE FOR TIRE CORD APPLICATIONS

[75] Inventors: Dong K. Kim, Akron; Robert M. Shemenski, North Canton, both of Ohio

[73] Assignee: The Goodyear Tire & Rubber Company, Akron, Ohio

[21] Appl. No.: 557,854

[22] Filed: Jul. 25, 1990

Related U.S. Application Data

[62] Division of Ser. No. 415,948, Oct. 2, 1989, Pat. No. 4,960,473.

[51] Int. Cl.[5] ..... C22C 38/18

[52] U.S. Cl. ..... 420/100; 148/12 B; 420/99; 420/107

[58] Field of Search ..... 148/12 B; 420/100, 99, 420/107

[56] References Cited

U.S. PATENT DOCUMENTS

| | | | |
|---|---|---|---|
| 3,530,703 | 9/1970 | Shimegi et al. | 420/107 |
| 3,900,347 | 8/1975 | Lorenzetti et al. | 148/12 B |
| 4,525,598 | 6/1985 | Tsukamoto et al. | 174/128 R |
| 4,642,219 | 2/1987 | Takata et al. | 420/100 |
| 4,759,806 | 7/1988 | Dambre | 148/12 B |

FOREIGN PATENT DOCUMENTS

| | | |
|---|---|---|
| 46-30931 | 9/1971 | Japan . |
| 58-027955 | 2/1983 | Japan . |
| 60-114517 | 6/1985 | Japan . |

*Primary Examiner*—Upendra Roy

*Attorney, Agent, or Firm*—Alvin T. Rockhill

[57] ABSTRACT

This invention reveals steel alloys which are particularly suitable for use in manufacturing reinforcing wires for rubber products, such as tires. The steel filaments made by this process have an outstanding combination of strength and ductility. Additionally, the steel alloys of this invention can be patented in a low cost process due to their having a very fast rate of isothermal transformation. This allows the steel in the steel wire being patented to transform from a face centered cubic microstructure to an essentially body centered cubic microstructure within a very short period. This invention more specifically discloses a steel alloy composition which is particularly suitable for use in manufacturing reinforcing wire for rubber products which consists essentially of (a) about 96.5 to about 99.05 weight percent iron, (b) about 0.6 to about 1 weight percent carbon, (c) about 0.1 to about 1 weight percent silicon, (d) about 0.1 to about 1.2 weight percent manganese, (e) about 0.1 to about 0.8 weight percent chromium, and (f) about 0.05 to about 0.5 weight percent cobalt.

8 Claims, No Drawings

ALLOY STEEL WIRES SUITABLE FOR TIRE CORD APPLICATIONS

This is a divisional of application Ser. No. 07/415,948, filed on Oct. 2, 1989, now issued as U.S. Pat. No. 4,960,473.

BACKGROUND OF THE INVENTION

It is frequently desirable to reinforce rubber articles, for example, tires, conveyor belts, power transmission belts, timing belts, hoses, and the like products, by incorporating therein steel reinforcing elements. Pneumatic vehicle tires are often reinforced with cords prepared from brass coated steel filaments. Such tire cords are frequently composed of high carbon steel or high carbon steel coated with a thin layer of brass. Such a tire cord can be a monofilament, but normally is prepared from several filaments which are stranded together. In most instances, depending upon the type of tire being reinforced, the strands of filaments are further cabled to form the tire cord.

It is important for the steel alloy utilized in filaments for reinforcing elements to exhibit high strength and ductility as well as high fatigue resistance. Unfortunately, many alloys which possess this demanding combination of requisite properties cannot be processed in a practical commercial operation. More specifically, it is extremely impractical to patent many such alloys which otherwise exhibit extremely good physical properties because they have a slow rate of isothermal transformation which requires a long period in the soak zone (transformation zone). In other words, in the patenting process a long time period in the transformation zone is required to change the microstructure of the steel alloy from face centered cubic to body centered cubic.

In commercial operations it is desirable for the transformation from a face centered cubic microstructure to a body centered cubic microstructure in the transformation phase of the patenting process to occur as rapidly as possible. The faster the rate of transformation, the less demanding the equipment requirements are at a given throughput. In other words, if more time is required for the transformation to occur, then the length of the transformation zone must be increased to maintain the same level of throughput. It is, of course, also possible to reduce throughputs to accommodate for the low rate of transformation by increasing the residence time in the transformation zone (soak). For these reasons, it is very apparent that it would be desirable to develop a steel alloy having a fast rate of isothermal transformation in patenting which also exhibits high strength, high ductility and high fatigue resistance.

The patenting process is a heat treatment applied to steel rod and wire having a carbon content of 0.25 percent or higher. The typical steel for tire reinforcement usually contains about 0.65 to 0.75% carbon, 0.5 to 0.7% manganese and 0.15 to 0.3% silicon, with the balance of course being iron. The object of patenting is to obtain a structure which combines high tensile strength with high ductility, and thus impart to the wire the ability to withstand a large reduction in area to produce the desired finished sizes possessing a combination of high tensile strength and good toughness.

Patenting is normally conducted as a continuous process and typically consists of first heating the alloy to a temperature within the range of about 850° C. to about 1150° C. to form austenite, and then cooling at a rapid rate to a lower temperature at which transformation occurs which changes the microstructure from face centered cubic to body centered cubic and which yields the desired mechanical properties. In many cases, while it is desired to form a single allotrope, a mixture of allotropes having more than one microstructure are in fact produced.

SUMMARY OF THE INVENTION

The subject invention discloses steel alloys which can be drawn into filaments which possess high strength, a high level of ductility and outstanding fatigue resistance. These alloys also exhibit a very rapid rate of transformation in patenting procedures.

The subject patent application more specifically reveals a steel alloy composition which is particularly suitable for use in manufacturing reinforcing wire for rubber products which consists essentially of (a) about 96.5 to about 99.05 weight percent iron, (b) about 0.6 to about 1 weight percent carbon, (c) about 0.1 to about 1 weight percent silicon, (d) about 0.1 to about 1.2 weight percent manganese, (e) about 0.1 to about 0.8 weight percent chromium, and (f) about 0.05 to about 0.5 weight percent cobalt.

The subject patent application also discloses a process for manufacturing steel filament which has an outstanding combination of strength and ductility which comprises the sequential steps of (1) heating a steel wire in a first patenting step to a temperature which is within the range of about 900° C. to about 1100° C. for a period of at least about 5 seconds, wherein said steel wire consists essentially of (a) about 95 to about 99.1 weight percent iron, (b) about 0.6 to about 1 weight percent carbon, (c) about 0.1 to about 1.2 weight percent manganese, (d) about 0.1 to about 2 weight percent silicon, and (e) about 0.1 to about 0.8 weight percent chromium; (2) rapidly cooling said steel wire to a temperature which is within the range of about 540° C. to about 620° C. within a period of less than about 4 seconds: (3) maintaining said steel wire at a temperature within the range of about 540° C. to about 620° C. for a period which is sufficient for the microstructure of the steel in the steel wire to transform to an essentially body centered cubic microstructure: (4) cold drawing the steel wire to a reduction in area which is sufficient to reduce the diameter of the steel wire by about 40 to about 80%; (5) heating the steel wire in a second patenting step to a temperature which is within the range of about 900° C. to about 1100° C. for a period of at least about 1 second; (6) rapidly cooling said steel wire to a temperature which is within the range of about 540° C. to about 620° C. within a period of less than about 4 seconds: (7) maintaining said steel wire at a temperature within the range of about 540° C. to about 620° C. for a period which is sufficient for the microstructure of the steel in the steel wire to transform to an essentially body centered cubic microstructure; and (8) cold drawing the steel wire to a reduction in area which is sufficient to reduce the diameter of the steel wire by about 60 to about 98% to produce said steel filament.

DETAILED DESCRIPTION OF THE INVENTION

The steel alloy compositions of this invention exhibit high strength, high ductility and high fatigue resistance. Additionally, they exhibit an extremely fast rate of isothermal transformation behavior. For instance, the alloys of this invention can be virtually completely transformed from a face centered cubic microstructure to a body centered cubic microstructure in a patenting procedure within about 20 seconds. In most cases, the alloys of this invention can be essentially fully transformed to a body centered cubic microstructure within less than about 10 seconds in the patenting process. This is very important since it is impractical in commercial processing operations to allow more than about 15 seconds for the transformation to occur. It is highly desirable for the transformation to be completed with about 10 or less. Alloys which require more than about 20 seconds for the transformation to occur are highly impractical.

Eight alloys were prepared which exhibit a satisfactory combination of properties. Of these alloys, one was determined to have an excellent combination of properties for utilization in steel filaments for rubber reinforcements. It consists essentially of from about 95.5 weight percent to about 99.05 weight percent iron, from about 0.6 weight percent to about 1 weight percent carbon, from about 0.1 weight percent to about 1 weight percent silicon, from about 0.1 weight percent to about 1.2 weight percent manganese, from about 0.1 weight percent to about 0.8 weight percent chromium and from about 0.05 weight percent to about 0.5 weight percent cobalt. This alloy preferably contains from about 97.4 weight percent to 98.5 weight percent iron, from about 0.7 weight percent to about 0.8 weight percent carbon, from about 0.1 weight percent to about 0.3 weight percent silicon, from about 0.4 weight percent to about 0.8 weight percent manganese, from about 0.2 weight percent to about 0.5 weight percent chromium, and from about 0.1 weight percent to about 0.2 weight percent cobalt.

An alloy which has a very good combination of properties consists essentially of 95.8 weight percent to about 99.3 weight percent iron, from about 0.4 weight percent to about 1 weight percent carbon, from about 0.1 weight percent to about 1 weight percent silicon, from about 0.1 weight percent to about 1.2 weight percent manganese, from about 0.05 weight percent to about 0.5 weight percent molybdenum, and from about 0.05 weight percent to about 0.5 weight percent cobalt. This alloy more preferably consists essentially of 97.6 weight percent to about 98.5 weight percent iron, from about 0.6 weight percent to about 0.7 weight percent carbon, from about 0.1 weight percent to about 0.3 weight percent silicon, from about 0.6 weight percent to about 1 weight percent manganese, from about 0.1 weight percent to about 0.2 weight percent molybdenum, and from about 0.1 weight percent to about 0.2 weight percent cobalt.

Another alloy which was determined to have a good combination of properties consists essentially of about 96 weight percent to about 99.1 weight percent iron, from about 0.6 weight percent to about 1 weight percent carbon, from about 0.1 weight percent to about 1.2 weight percent manganese, from about 0.1 weight percent to about 1 weight percent silicon, and from about 0.1 weight percent to about 0.8 weight percent chromium. This alloy preferably consists essentially of from about 97.5 weight percent to about 98.5 weight percent iron, from about 0.8 weight percent to about 0.9 weight percent carbon, from about 0.2 weight to about 0.5 weight percent manganese, from about 0.3 weight percent to about 0.7 weight percent silicon and from about 0.2 weight percent to about 0.4 weight percent chromium.

A further alloy which was determined to have a good combination of properties consists essentially of from about 95.74 weight percent to about 99.09 weight percent iron, from about 0.6 weight percent to about 1 weight percent carbon, from about 0.1 weight percent to about 1 weight percent silicon, from about 0.1 weight percent to about 1.2 weight percent manganese, from about 0.01 weight percent to about 0.06 weight percent niobium, from about 0.05 weight percent to about 0.5 weight percent molybdenum, and from about 0.05 weight percent to about 0.5 weight percent cobalt. This alloy preferably consists essentially of from about 97.66 weight percent to about 98.58 weight percent iron, from about 0.7 weight percent to about 0.8 weight percent carbon, from about 0.1 weight percent to about 0.3 weight percent silicon, from about 0.4 weight percent to about 0.8 weight percent manganese, from about 0.02 weight percent to about 0.04 weight percent niobium, from about 0.1 weight percent to about 0.2 weight percent molybdenum, and from about 0.1 weight percent to about 0.2 weight percent cobalt.

An alloy which has a satisfactory combination of properties consists essentially of from about 96.3 weight percent to about 99.15 weight percent iron, from about 0.6 weight percent to about 1 weight percent carbon, from about 0.1 weight percent to about 1 weight percent silicon, from about 0.1 weight percent to about 1.2 weight percent manganese and from about 0.05 weight percent to about 0.5 weight percent vanadium. This alloy preferably consists essentially of from about 97.9 weight percent to about 98.7 weight percent iron, from about 0.7 weight percent to about 0.8 weight percent carbon, from about 0.1 weight percent to about 0.3 weight percent silicon, from about 0.4 weight percent to about 0.8 weight percent manganese and from about 0.1 weight percent to about 0.2 weight percent vanadium.

Another alloy which was determined to have a satisfactory combination of properties consists essentially of from about 95.4 weight percent to about 99.29 weight percent iron, from about 0.4 weight percent to about 1 weight percent carbon, from about 0.1 weight percent to about 1 weight percent silicon, from about 0.1 weight percent to about 1.2 weight percent manganese, from about 0.1 weight percent to about 0.8 weight percent chromium and from about 0.01 weight percent to about 0.06 weight percent niobium. This alloy preferably consists essentially of from about 97.66 weight percent to about 98.68 weight percent iron, from about 0.6 weight percent to about 0.7 weight percent carbon, from about 0.1 weight percent to about 0.3 weight percent silicon, from about 0.4 weight percent to about 0.8 weight percent manganese, and from about 0.2 weight percent to about 0.5 weight percent chromium, from about 0.02 weight percent to about 0.04 weight percent niobium.

Another alloy which was determined to have a satisfactory combination of properties consists essentially of from about 94.94 weight percent to about 98.99 weight percent iron, from about 0.6 weight percent to about 1 weight percent carbon, from about 0.1 weight percent to about 1 weight percent silicon, from about 0.1 weight percent to about 1.2 weight percent manganese, from about 0.1 weight percent to about 0.8 weight percent chromium, from about 0.05 weight percent to about 0.5 weight percent vanadium, from about 0.01 weight percent to about 0.06 weight percent niobium, and from about 0.05 weight percent to about 0.5 weight percent cobalt. This alloy preferably consists essentially of from about 97.16 weight percent to about 98.38 weight percent iron, from about 0.7 weight percent to about 0.8 weight percent carbon, from about 0.1 weight percent to about 0.3 weight percent silicon, from about 0.4 weight percent to about 0.8 weight percent manganese, from about 0.2 weight percent to about 0.5 weight percent chromium, from about 0.1 weight percent to about 0.2 weight percent vanadium, from about 0.02 weight percent to about 0.04 weight percent niobium and from about 0.1 weight percent to about 0.2 weight percent cobalt.

Another alloy which was determined to have a satisfactory combination of properties consists essentially of from about 94 to about 99.29 weight percent iron, from about 0.4 weight percent to about 1 weight percent carbon, from about 0.1 weight percent to about 1 weight percent silicon, from about 0.1 weight percent to about 1.2 weight percent manganese, from about 0.05 weight percent to about 0.5 weight percent vanadium, from about 0.05 weight percent to about 0.5 weight percent molybdenum, and from about 0.01 weight percent to about 0.06 weight percent niobium. This alloy preferably consists from about 97.76 weight percent to about 98.68 weight percent iron, from about 0.6 weight percent to about 0.7 weight percent carbon, from about 0.1 weight percent to about 0.3 weight percent silicon, from about 0.4 weight percent to about 0.8 weight percent manganese, from about 0.1 weight percent to about 0.2 weight percent vanadium, from about 0.1 weight percent to about 0.2 weight percent molybdenum, and from about 0.02 weight percent to about 0.04 weight percent niobium.

A further alloy which was determined to have a satisfactory combination of properties consists essentially of from about 95.74 weight percent to about 99.09 weight percent iron, from about 0.6 weight percent to about 1 weight percent carbon, from about 0.1 weight percent to about 1 weight percent silicon, from about 0.1 weight percent to about 1.2 weight percent manganese, from about 0.01 weight percent to about 0.06 weight percent niobium, from about 0.05 weight percent to about 0.5 weight percent molybdenum, and from about 0.05 weight percent to about 0.5 weight percent cobalt. This alloy preferably consists essentially of from about 97.26 weight percent to about 98.38 weight percent iron, from about 0.7 weight percent to about 0.8 weight percent carbon, from about 0.3 weight percent to about 0.7 weight percent silicon, from about 0.4 weight percent to about 0.8 weight percent manganese, from about 0.02 weight percent to about 0.04 weight percent niobium, from about 0.1 weight percent to about 0.2 weight percent molybdenum, and from about 0.1 weight percent to about 0.2 weight percent cobalt.

Rods having a diameter of about 5 mm to about 6 mm which are comprised of the steel alloys of this invention can be manufactured into steel filaments which can be used in reinforcing elements for rubber products. Such steel rods are typically cold drawn to a diameter which is within the range of about 2.8 mm to about 3.5 mm. For instance, a rod having a diameter of about 5.5 mm can be cold drawn to a wire having a diameter of about 3.2 mm. This cold drawing procedure increases the strength and hardness of the metal.

The cold drawn wire is then patented by heating the wire to a temperature which is within the range of 900° C. to about 1100° C. for a period of at least about 5 seconds. In cases where electrical resistance heating is used, a heating period of about 5 to about 15 seconds is typical. It is more typical for the heating period to be within the range of about 6 to about 10 seconds when electrical resistance heating is used. It is, of course, also possible to heat the wire in a fluidized bed oven. In such cases, the wire is heated in a fluidized bed of sand having a small grain size. In fluidized bed heating techniques, the heating period will generally be within the range of about 10 seconds to about 30 seconds. It is more typical for the heating period in a fluidized bed oven to be within the range of about 15 seconds to about 20 seconds. It is also possible to heat the wire for the patenting procedure in a convection oven. However, in cases where convection heating is used, longer heating periods are required. For instance, it is typically necessary to heat the wire by convection for a period of at least about 40 seconds. It is preferable for the wire to be heated by convection for a period within the range of about 45 seconds to about 2 minutes.

The exact duration of the heating period is not critical. However, it is important for the temperature to be maintained for a period which is sufficient for the alloy to be austenitized. In commercial operations, temperatures within the range of 950° C. to about 1050° C. are utilized to austenitize the alloy in the wire.

In the patenting procedure after the austenite has formed, it is important to rapidly cool the steel wire to a temperature which is within the range of about 540° C. to about 620° C. within a period of less than about 4 seconds. It is desirable for this cooling to take place within a period of 3 seconds or less. This rapid cooling can be accomplished by immersing the wire in molten lead which is maintained at a temperature of 580° C. Numerous other techniques for rapidly cooling the wire can also be employed.

After the wire has been quenched to a temperature within the range of about 540° C. to about 620° C., it is necessary to maintain the wire at a temperature within that range for a period of time which is sufficient for the microstructure of the steel in the steel wire to transform to an essentially face centered cubic microstructure from the body centered cubic microstructure of the austenite. As has been indicated, for practical reasons it is very important for this transformation to occur within about 15 seconds with it being highly preferably for the transformation to occur within a period of 10 seconds or less.

The patenting procedure is considered to be completed after the transformation to an essentially body centered cubic microstructure has been attained. After the completion of the first patenting step, the patented wire is further drawn using a cold drawing procedure. In this drawing step, the diameter of the wire is reduced by about 40 to about 80 percent. It is preferred for the diameter of the wire to be reduced by 50 percent to 60 percent in the drawing procedure. After this drawing procedure has been completed, the drawn wire typically has a diameter of from about 1 mm to about 2 mm. For example, a wire having an original diameter of 3.2 mm could be drawn to a diameter of about 1.4 mm.

The cold drawn wire is then patented in a second patenting step. This second patenting procedure is done utilizing essentially the same techniques as are employed in the first patenting step. However, due to the reduced diameter of the wire, less heating time is required to austenitize the alloy in the wire. For instance, if electrical resistance heating is utilized, the heating step in the second patenting procedure can be accomplished in as little as about 1 second. However, it may be necessary to expose the wire to electrical resistance heating for a period of 2 seconds or longer for the alloy to be austenitized as required. In cases where a fluidized bed oven is employed for heating, a heating time of 4 to 12 seconds is typical. In situations where convection heating is used, a heating time within the range of about 15 seconds to about 60 seconds is typical.

After the wire has completed the second patenting procedure, it is, again, cold drawn. In this cold drawing procedure, the diameter of the wire is reduced by about 60 percent to about 98 percent to produce the steel filaments of this invention. It is more typical for the diameter of the wire to be reduced by about 85 percent to about 90 percent. Thus, the filaments of this invention typically have a diameter which is within the range of about 0.15 mm to about 0.38 mm. Filaments having a diameter of about 0.175 mm are typical.

In many cases it will be desirable to twist two or more filaments into cable for utilization as reinforcements for rubber products. For instance, it is typical to twist two such filaments into cable for utilization in passenger tires. It is, of course, also possible to twist a larger number of such filaments into cable for utilization in other applications. For instance, it is typical to twist about 50 filaments into cables which are ultimately employed in earth mover tires. In many cases it is desirable to coat the steel alloy with a brass coating. Such a procedure for coating steel reinforcing elements with a ternary brass alloy is described in U.S. Pat. No. 4,446,198, which is incorporated herein by reference.

The present invention will be described in more detail in the following examples. These examples are merely for the purpose of illustration and are not to be regarded as limiting the scope of the invention or the manner in which it may be practiced. Unless specifically indicated otherwise, all parts and percentages are given by weight.

EXAMPLES 1-9

In this experiment, nine alloys were prepared and tested by quenching dilatometry to determine isothermal transformation times. The approximate amounts of various metals in these nine alloys are shown in Table I. The amounts shown in Table I are weight percentages.

TABLE I

| Ex | Fe | C | Si | Mn | Cr | V | Nb | Mo | Co |
|---|---|---|---|---|---|---|---|---|---|
| 1 | 98.15 | .65 | .20 | .80 | — | — | — | .10 | .10 |
| 2 | 98.05 | .75 | .20 | .60 | .30 | — | — | — | .1 |
| 3 | 98.1 | .80 | .50 | .30 | .30 | — | — | — | — |
| 4 | 98.22 | .75 | .20 | .60 | — | — | .03 | .10 | .10 |
| 5 | 98.15 | .75 | .20 | .80 | — | .10 | — | — | — |
| 6 | 98.02 | .65 | .20 | .80 | .30 | — | .03 | — | — |
| 7 | 97.17 | .75 | .75 | .80 | .30 | .10 | .03 | — | .10 |
| 8 | 98.32 | .65 | .20 | .60 | — | .10 | .03 | .10 | — |
| 9 | 97.92 | .75 | .50 | .60 | — | — | .03 | .10 | .10 |

The dilatometry testing simulated the heat treatment cycle in a patenting procedure. It consisted of three steps. Each of the alloys was austenitized at 980° C. for 64 seconds. After being austenitized, each of the alloys was quenched to 550° C. within a period of 4 seconds. Measurements were made to determine how long it took for the microstructure in each of the alloys to begin changing from a face centered cubic microstructure to a body centered cubic microstructure (start). This determination was made by monitoring the evolution of heat. It was also confirmed by examination of an expansion curve and the actual microstructures of quenched samples. The time required for the microstructure of the alloy to essentially fully convert to a body centered cubic microstructure was also measured (finish). These times are shown in Table II for each of the alloys.

TABLE II

| Example | Transformation Rates Start (sec.) | Finish (sec.) |
|---|---|---|
| 1 | 1 | 5 |
| 2 | 3 | 10 |
| 3 | 5 | 15 |
| 4 | 0 | 3.5 |
| 5 | 1 | 6 |
| 6 | 2 | 7 |
| 7 | 1 | 9 |
| 8 | 1 | 6.5 |
| 9 | 1 | 5 |

As can be seen, the total transformation time required for the alloy of Example 4 was only 3.5 seconds. All of the alloys with the exception of Example 3 had transformation times of 10 seconds or less. Example 3 had a transformation rate which was somewhat slow. However, the physical properties of filaments made from the alloy of Example 3 were exceptionally good.

Steel rods which were comprised of each of the nine alloys were processed into 0.25 mm filaments. This was done by cold drawing 5.5 mm rods of each of the alloys into 3.2 mm wires. The wires were then patented and again cold drawn to a diameter of about 1.4 mm. The wires were again patented in a second patenting step and subsequently again cold drawn to the final filament diameter of 0.25 mm. The filaments made were then tested to determine their tensile strength, percentage of elongation at break, and reduction of area at break. These physical parameters are reported in Table III.

TABLE III

| Example | Tensile Strength | Elongation | Reduction of Area |
|---|---|---|---|
| 1 | 2690 MPa | 2.2% | 47% |
| 2 | 3110 MPa | 2.4% | 38% |
| 3 | 3100 MPa | — | 52% |
| 4 | 3038 MPa | 2.3% | 39% |
| 5 | 3034 MPa | 2.3% | 41% |
| 6 | 2610 MPa | 2.1% | 34% |
| 7 | 2971 MPa | 2.3% | 45% |
| 8 | 2670 MPa | 2.2% | 42% |
| 9 | 3076 MPa | 2.3% | 41% |

As can be seen, each of the nine alloys exhibited an excellent combination of both high tensile strength and high ductility. As has been shown, these alloys can also be patented on a practical commercial basis by virtue of their fast rates of transformation.

COMPARATIVE EXAMPLES 10-30

The nine alloys of this invention offer an unusual combination of high tensile strength, high ductility and fast rates of transformation. This series of comparative examples is included to show that many similar alloys have rates of transformation which are unsatisfactory. In this comparative experiment, 21 alloys were prepared and tested by quenching dilatometry as described in Examples 1-9. The approximate amounts of the various metals in the 21 alloys tested are shown in Table IV. The amounts shown in Table IV are weight percentages.

TABLE IV

| Ex | Fe | C | Si | Mn | Cr | V | Nb | Mo | Co |
|---|---|---|---|---|---|---|---|---|---|
| 10 | 97.85 | .65 | .50 | .80 | — | — | — | .10 | .10 |
| 11 | 97.45 | .65 | .50 | .80 | .30 | .10 | — | .10 | .10 |
| 12 | 97.75 | .75 | .50 | .60 | .30 | — | — | — | .10 |
| 13 | 97.85 | .75 | .50 | .80 | — | .10 | — | — | — |
| 14 | 97.50 | .75 | .75 | .80 | — | .10 | — | .10 | — |
| 15 | 97.72 | .65 | .50 | .80 | .30 | — | .03 | — | — |
| 16 | 97.37 | .75 | .75 | .80 | .30 | — | .03 | — | — |
| 17 | 97.95 | .75 | .20 | .60 | .30 | .10 | — | .10 | — |
| 18 | 97.65 | .75 | .50 | .60 | .30 | .10 | — | .10 | — |
| 19 | 97.37 | .75 | .75 | .60 | .30 | .10 | .03 | .10 | — |
| 20 | 98.02 | .75 | .20 | .80 | — | .10 | .03 | — | .10 |
| 21 | 97.72 | .75 | .50 | .80 | — | .10 | .03 | — | .10 |
| 22 | 97.82 | .75 | .20 | .80 | .30 | — | .03 | .10 | — |
| 23 | 97.52 | .75 | .50 | .80 | .30 | — | .03 | .10 | — |
| 24 | 97.17 | .75 | .75 | .80 | .30 | .10 | .03 | .10 | — |
| 25 | 98.02 | .65 | .20 | .60 | .30 | .10 | .03 | — | .10 |
| 26 | 97.72 | .65 | .50 | .60 | .30 | .10 | .03 | — | .10 |
| 27 | 97.72 | .65 | .75 | .80 | .30 | .10 | .03 | — | .10 |
| 28 | 98.02 | .65 | .50 | .60 | — | .10 | .03 | .10 | — |
| 29 | 97.67 | .75 | .75 | .60 | — | .10 | .03 | .10 | — |
| 30 | 97.47 | .75 | .75 | .80 | — | — | .03 | .10 | .10 |

The transformation rates for each of the 21 alloys evaluated are reported in Table V.

TABLE V

| Example | Start (sec.) | Finish (sec.) |
|---|---|---|
| 10 | 3 | 11 |
| 11 | 20 | NF |
| 12 | 3 | 11 |
| 13 | 2 | 14 |
| 14 | 19 | 49 |
| 15 | 14 | 21 |
| 16 | 8 | 45 |
| 17 | 13 | 35 |
| 18 | 25 | NF |
| 19 | 30 | NF |
| 20 | 1.9 | 14 |
| 21 | 1.5 | 11 |
| 22 | 25 | 48 |
| 23 | 35 | NF |
| 24 | 30 | NF |
| 25 | 2 | 20 |
| 26 | 6 | 31 |
| 27 | 15 | 45 |
| 28 | 3 | 19 |
| 29 | 9 | 36 |
| 30 | 8 | 25 |

As can be seen, none of the comparative alloys tested finished (converted to an essentially body centered cubic microstructure) in less than 10 seconds. Thus, none of the comparative alloys made can be patented easily on a commercial basis. On the other hand, the alloys made in Examples 1, 4 and 9 finished in 5 seconds or less.

While certain representative embodiments and details have been shown for the purpose of illustrating this invention, it will be apparent to those skilled in this art that various changes and modifications can be made herein without departing from the scope of this invention.

What is claimed is:

1. A steel alloy composition which is particularly suitable for use in manufacturing reinforcing wire for rubber products which consists essentially of (a) about 95.8 to about 99.3 weight percent iron, (b) about 0.40 to about 1 weight percent carbon, (c) about 0.1 to about 1.2 weight percent manganese, (d) about 0.1 to about 1 weight percent silicon, (e) about 0.05 to about 0.5 weight percent molybdenum and (f) about 0.05 to about 0.5 weight percent cobalt.

2. A steel alloy composition which is particularly suitable for use in manufacturing reinforcing wire for rubber products which consists essentially of (a) about 95.2 to about 99 weight percent iron, (b) about 0.6 to about 1 weight percent carbon, (c) about 0.1 to about 1.2 weight percent manganese, (d) about 0.1 to about 1 weight percent silicon, (e) about 0.1 to about 0.6 weight percent niobium (f) about 0.05 to about 0.5 weight percent molybdenum, and (g) about 0.05 to about 0.5 weight percent cobalt.

3. A steel alloy composition as specified in claim 1 wherein the composition consists essentially of (a) about 97.6 to about 98.5 weight percent iron, (b) about 0.6 to about 0.7 weight percent carbon, (c) about 0.6 to about 1.0 weight percent manganese, (d) about 0.1 to about 0.3 weight percent silicon, (e) about 0.1 to about 0.2 weight percent molybdenum and (f) about 0.1 to about 0.2 weight percent cobalt.

4. A steel alloy composition as specified in claim 2 wherein the composition consists essentially of (a) about 97.66 to about 98.58 weight percent iron, (b) about 0.7 to about 0.8 weight percent carbon, (c) about 0.4 to about 0.8 weight percent manganese, (d) about 0.1 to about 0.3 weight percent silicon, (e) about 0.02 to about 0.04 weight percent niobium (f) about 0.1 to about 0.2 weight percent molybdenum, and (g) about 0.1 to about 0.2 weight percent cobalt.

5. A steel alloy composition which is particularly suitable for use in manufacturing reinforcing wire for rubber products which consists essentially of (a) about 94 to about 99.29 weight percent iron, (b) about 0.4 to about 1 weight percent carbon, (c) about 0.1 to about 1.2 weight percent manganese, (d) about 0.1 to about 1 weight percent silicon, (e) about 0.05 to about 0.5 weight percent vanadium, (f) about 0.05 to about 0.5 weight percent molybdenum, and (g) about 0.01 to about 0.06 weight percent niobium.

6. A steel alloy composition as specified in claim 5 wherein the composition consists essentially of (a) about 97.76 to about 98.68 weight percent iron, (b) about 0.6 to about 0.7 weight percent carbon, (c) about 0.4 to about 0.8 weight percent manganese, (d) about 0.1 to about 0.3 weight percent silicon, (e) about 0.1 to about 0.2 weight percent vanadium, (f) about 0.1 to about 0.2 weight percent molybdenum, and (g) about 0.02 to about 0.04 weight percent niobium.

7. A steel alloy composition which is particularly suitable for use in manufacturing reinforcing wire for rubber products which consists essentially of (a) about 95.74 to about 99.09 weight percent iron, (b) about 0.6 to about 1 weight percent carbon, (c) about 0.1 to about 1.2 weight percent manganese, (d) about 0.1 to about 1 weight percent silicon, (e) about 0.01 to about 0.06 weight percent niobium, (f) about 0.05 to about 0.5 weight percent molybdenum, and (g) about 0.05 to about 0.5 weight percent cobalt.

8. A steel alloy composition as specified in claim 7 wherein the composition consists essentially of (a) about 97.26 to about 98.38 weight percent iron, (b) about 0.7 to about 0.8 weight percent carbon, (c) about 0.4 to about 0.8 weight percent manganese, (d) about 0.3 to about 0.7 weight percent silicon, (e) about 0.02 to about 0.04 weight percent niobium, (f) about 0.1 to about 0.2 weight percent molybdenum, and (g) about 0.1 to about 0.2 weight percent cobalt.

* * * * *